US006435689B2

(12) United States Patent
Pitts

(10) Patent No.: US 6,435,689 B2
(45) **Date of Patent: *Aug. 20, 2002**

(54) HAND HELD LIGHTING DEVICE HAVING A LUMINESCENT BODY

(76) Inventor: Algerome Pitts, 56 Freeman St., Newark, NJ (US) 07105

( * ) Notice: Subject to any disclaimer, the term of this patent is extended or adjusted under 35 U.S.C. 154(b) by 0 days.

This patent is subject to a terminal disclaimer.

(21) Appl. No.: 09/779,387

(22) Filed: Feb. 8, 2001

Related U.S. Application Data

(63) Continuation-in-part of application No. 09/256,027, filed on Feb. 23, 1999, now Pat. No. 6,186,634.

(51) Int. Cl.[7] ..... F21V 9/16

(52) U.S. Cl. ..... 362/84; 362/208

(58) Field of Search ..... 362/84, 208, 189, 362/183

(56) References Cited

U.S. PATENT DOCUMENTS 6,186,634 B1 * 2/2001 Pitts ..... 362/208

* cited by examiner

*Primary Examiner*—Sandra O'Shea
*Assistant Examiner*—Hargobind S. Sawhney

(57) ABSTRACT

A hand held lighting device having a luminescent body for providing a light source in the absence of light. The hand held lighting device includes a housing having an outer curved wall surface and an end wall. The housing includes an attached lamp assembly having a light bulb, a reflector member and a lens therein. The housing also includes a battery cover and an interior compartment having a battery section for receiving one or more batteries for supplying power to the lamp assembly. The hand held lighting device includes a switching device in the housing for switching the lamp assembly to battery power in order to energize the lamp assembly. The housing further includes female socket receptacle for connectedly attaching to a battery charger for the recharging of the batteries for supplying power to the lamp assembly; and a luminescent coating for producing a light source on the outer curved wall surface, the battery cover and the end wall for affording visibility to the housing of hand held lighting device in the absence of any other light source, wherein the luminescent coating being formed on, adhered and bonded to the outer curved wall surface, the end wall and the battery cover of the housing, as a distinct and separate layer thereon. The hand held lighting device also includes a clear and transparent shell housing cover for protecting the luminescent coating from wearing off. Additionally, the clear and transparent shell housing cover is detachably connected to the lamp assembly by a connecting member.

24 Claims, 2 Drawing Sheets

HAND HELD LIGHTING DEVICE HAVING A LUMINESCENT BODY

RELATED APPLICATION

This patent application is related to U.S. Pat. No. 6,186,634 issued on Feb. 13, 2001, being a continuation-in-part application Ser. No. 09/256,027, filed on Feb. 23, 1999.

FIELD OF THE INVENTION

This invention relates to a hand held lighting device. More particularly, to a hand held lighting device having a luminescent body for providing a light source in which to locate the hand held lighting device in the absence of light

BACKGROUND OF THE INVENTION

Flashlights, hand held lighting devices having light reflectors, reflective tape; reflective paint thereon are commonly used to locate these devices for normal or emergency situations involving power failures, fires, smog, earthquakes and the like, where interior or exterior areas have a minimum or complete absence of light. These devices are typically stored on shelves, walls, or on cabinets to facilitate their locations.

Many types of materials are known to help reflect light or transmit light, these include reflective metallic materials, reflective paints and chemiluminescent materials. Most of the aforementioned materials will only function in the presence of some light.

There remains a need for a hand held lighting device having a luminescent body for providing a light source to locate the hand held lighting device in an interior or exterior area having a minimum or complete absence of light.

DESCRIPTION OF THE PRIOR ART

Flashlights, hand held lighting devices and other luminescent devices of various designs, styles, structures, configurations, and materials of construction have been disclosed in the prior art. For example, U.S. Pat. No. 4,401,050 to BRITT et al discloses a phosphorescent escape route indicator having at least one protruding indicia formed within or attached to a sheet of material. The protruding indicia has incorporated therewith a phosphorescent substance capable of emitting a glow in the absence of light. An adhesive formed as part of the sheet is utilized to apply the indicator to the surface of walls or stairways thereby aiding in delineating escape route or access routes to emergency equipment during time of emergency. This prior art patent does not disclose or teach a hand held lighting device having luminosity, being a luminescent coating thereon, for emergency or non-lighted conditions in which to illuminate the surfaces of such flashlights, and give them visibility in the absence of any light source; and wherein the luminescent coating has a protective plastic covering thereon to prevent the luminescent coating from wearing-off.

U.S. Pat. No. 4,708,817 to DUDNICK discloses a container having a latent message on the container's surface is coated with a luminescent, phosphorescent and/or fluorescent material, such that the warning message glows and is clearly discernible in the dark. This prior art patent does not disclose or teach a hand held lighting device having luminosity, being a luminescent coating thereon, for emergency or non-lighted conditions in which to illuminate the surfaces of such flashlights, and give them visibility in the absence of any light source; and wherein the luminescent coating has a protective plastic covering thereon to prevent the luminescent coating from wearing-off.

U.S. Pat. No. 4,943,896 to JOHNSON discloses a method of producing improved infant care articles, such as baby bottle assemblies, characterized by the inclusion of a non-toxic, non-irritating phosphorescent material with the material of construction of components of the infant care articles so that such components phosphorescently emit light visible in a darkened environment, allowing the location and position of the articles to be readily determined without the need for an additional light source. This prior art patent does not disclose or teach a hand held lighting device having luminosity, being a luminescent coating thereon, for emergency or non-lighted conditions in which to illuminate the surfaces of such flashlights, and give them visibility in the absence of any light source; and wherein the luminescent coating has a protective plastic covering thereon to prevent the luminescent coating from wearing-off.

U.S. Pat. No. 5,007,647 to GLUCK discloses a luminescent golf ball including a distinct luminescent coating formed and adhered to the entire outer curved surface, the luminescent coating is made from a luminescent chemical material in different colors being white, red, yellow or green, and has a clear and transparent shell protecting the luminescent coating. This prior art patent does not disclose or teach a hand held lighting device having luminosity, being a luminescent coating thereon, for emergency or non-lighted conditions in which to illuminate the surfaces of such flashlights, and give them visibility in the absence of any light source; and wherein the luminescent coating has a protective plastic covering thereon to prevent the luminescent coating from wearing-off.

U.S. Pat. No. 5,172,937 to SACHETTI discloses structures, such as labels on beer bottles having fluorescent and phosphorescent materials that emit and reflect light to provide a sense of identity to the beer bottle. The label is in the form of a blanket that has a protective grid of phosphorescent material thereon, such that when the phosphorescent material is exposed to light and placed in a dark environment the beer bottle label emits light for a period time. The protective grid is a pattern of intersecting ribbons of phosphorescent material anchored to and covering substantially one surface of the label. The protective grid provides a visual light shield that creates an image of identification for that label. This prior art patent does not disclose or teach a hand held lighting device having luminosity, being a luminescent coating thereon, for emergency or non-lighted conditions in which to illuminate the surfaces of such flashlights, and give them visibility in the absence of any light source; and wherein the luminescent coating has a protective plastic covering thereon to prevent the luminescent coating from wearing-off.

U.S. Pat. No. 5,502,623 to BROTZ discloses an illuminated clipboard having a transparent body with a light-emitting, light-diffusing upper surface and a curved bottom surface wherein the bottom surface curves upward at its sides to meet the top surface with a light source disposed within the transparent body of the clipboard to reflect light off the curved bottom which causes the light within the transparent body of the clipboard to be reflected off the bottom surface to the light-emitting, light-diffusing upper surface to illuminate what is positioned on the light-emitting, light-diffusing upper surface of the clipboard. This prior art patent does not disclose or teach a hand held lighting device having luminosity, being a luminescent coating thereon, for emergency or non-lighted conditions in which to illuminate the surfaces of such flashlights, and give them visibility in the absence of any light source; and wherein the luminescent coating has a protective plastic covering thereon to prevent the luminescent coating from wearing-off.

U.S. Pat. No. 5,654,552 to TOOMBS discloses a glow-in-the-dark lamp shade that includes a glow-in-the-dark region with a first side disposed toward a light source so that the light source illuminates the first side and with a second side disposed away from the light source. The glow-in-the-dark region includes a glow-in-the-dark substance that stores energy for illumination and that responds to the stored energy by emitting light in the visible range. This prior art patent does not disclose or teach a hand held lighting device having luminosity, being a luminescent coating thereon, for emergency or non-lighted conditions in which to illuminate the surfaces of such flashlights, and give them visibility in the absence of any light source; and wherein the luminescent coating has a protective plastic covering thereon to prevent the luminescent coating from wearing-off.

U.S. Pat. No. 5,752,761 to PIETRUCZYNIK discloses a high visibility flashlight body having a luminescent outer surface on the main body and closure cap. The outer surface includes a luminescent colorant composition in the base material, being distributed throughout the thickness of the main body. This prior art patent also teaches that the fluorescent colorants can be in either the outer layer or incorporated into the substrate layer of the main body of the flashlight. This prior art patent does not disclose or teach a hand held lighting device having luminosity, being a luminescent coating thereon, for emergency or non-lighted conditions in which to illuminate the surfaces of such flashlights, and give them visibility in the absence of any light source; and wherein the luminescent coating has a protective plastic covering thereon to prevent the luminescent coating from wearing-off.

U.S. Pat. No. 5,882,239 to TRICHAK discloses an illuminatable plastic disc that spins and flies when thrown that include chemiluminescent composition passages that extend radially across substantially the entire disc so when the disc spins in darkness, the entire disc appears illuminated. The chemiluminescent passages are formed integrally with the disc. This prior art patent does not disclose or teach a hand held lighting device having luminosity, being a luminescent coating thereon, for emergency or non-lighted conditions in which to illuminate the surfaces of such flashlights, and give them visibility in the absence of any light source; and wherein the luminescent coating has a protective plastic covering thereon to prevent the luminescent coating from wearing-off.

U.S. Pat. Nos. 5,450,173 and 5,898,508 to BERANICH discloses a portable duplicating device which may be used with any commercially available photocopy machine to provide two-dimensional copies of two or three dimensional objects. This duplicating device includes a luminescent box for illuminating the inside of the box for providing two-dimensional reproductions of two or three-dimensional objects. This prior art patent does not disclose or teach a hand held lighting device having luminosity, being a luminescent coating thereon, for emergency or non-lighted conditions in which to illuminate the surfaces of such flashlights, and give them visibility in the absence of any light source; and wherein the luminescent coating has a protective plastic covering thereon to prevent the luminescent coating from wearing-off.

None of these prior art patents disclose or teach a hand held lighting device having luminosity, being a luminescent coating thereon, for emergency or non-lighted conditions in which to illuminate the surfaces of such flashlights, and give them visibility in the absence of any light source; and wherein the luminescent coating has a protective plastic covering thereon to prevent the luminescent coating from wearing-off.

Accordingly, it is an object of the present invention to provide a hand held lighting device having a luminescent body for producing a bright light source in order to locate the hand held lighting device in the absence of light.

Another object of the present invention is to provide a hand held lighting device that includes a luminescent body having a coating made from luminescent chemical materials selected from the group consisting of white phosphorous, red phosphorous, phosphors, organic guanines (fish scales), metallic and non-metallic micas, bismuth oxychloride, phosphorous oxychloride, or other chemiluminescent materials.

Another object of the present invention is to provide a hand held lighting device that produces a light source from a luminescent material which glows white, red, yellow or green in the absence of light.

Another object of the present invention is to provide a hand held lighting device that includes a shell housing cover for protecting the luminescent coating on the housing of the lighting device from wearing off or deteriorate through normal use and handling.

A further object of the present invention is to provide a hand held lighting device having a luminescent coating that is long-lasting, durable in use, and reliable for producing a light source in the absence of light. A still further object of the present invention is to provide a hand held lighting device having a luminescent coating that may be mass produced in an automated and economical manner and is readily affordable by the user.

SUMMARY OF THE INVENTION

The present invention provides for a hand held lighting device having a luminescent body for providing a light source in the absence of light. The hand held lighting device includes a housing having an outer curved wall surface and an end wall. The housing includes an attached lamp assembly having a light bulb, a reflector member and a lens therein. The housing also includes a battery cover and an interior compartment having a battery section for receiving one or more batteries for supplying power to the lamp assembly. The hand held lighting device includes a switching device in the housing for switching the lamp assembly to battery power in order to energize the lamp assembly. The housing further includes female socket receptacle for connectedly attaching to a battery charger for the recharging of the batteries for supplying power to the lamp assembly; and a luminescent coating for producing a light source on the outer curved wall surface, the battery cover and the end wall for affording visibility to the housing of hand held lighting device in the absence of any other light source, wherein the luminescent coating being formed on, adhered and bonded to the outer curved wall surface, the end wall and the battery cover of the housing, as a distinct and separate layer thereon. The hand held lighting device also includes a clear and transparent shell housing cover for protecting the luminescent coating from wearing off. Additionally, the clear and transparent shell housing cover is detachably connected to the lamp assembly by a connecting member.

BRIEF DESCRIPTION OF THE DRAWINGS

Further objects, features, and advantages of the present invention will become apparent upon the consideration of the following detailed description of the presently-preferred embodiment when taken in conjunction with the accompanying drawings, wherein.

GLOSSARY OF THE COMPONENT PARTS

GLOSSARY OF THE COMPONENT PARTS

| Part No. | Description of the Component Parts |
|---|---|
| 10 | hand held lighting device |
| 20 | housing being cylindrical in shape |
| 22 | an outer curved wall |
| 24 | end wall |
| 26 | an outer threaded perimeter edge |
| 28 | a substantially rectangular opening |
| 29a | curved wall edge |
| 29b | curved wall edge |
| 30 | for receiving a battery cover |
| 32a | battery cover hinges |
| 32b | battery cover hinges |
| 32c | battery cover hinges |
| 34 | battery cover locking member |
| 38 | luminescent coating |
| 38S | alight source |
| 40 | an interior compartment |
| 42 | a battery storage section |
| 44 | left end wall |
| 46 | right end wall |
| 48 | center dividing wall |
| 50a | battery compartment |
| 50b | battery compartment |
| 52a | "D" battery |
| 52b | "D" battery |
| 54a | positive terminal |
| 54b | positive terminal |
| 56a | negative terminal |
| 56b | negative terminal |
| 58 | a switch opening |
| 60 | a lamp assembly |
| 62 | a light bulb |
| 64 | a reflector member |
| 66 | a reflector section |
| 68 | a threaded circular receiving channel |
| 70 | a neck section |
| 72 | a threaded circular receiving channel |
| 74 | an inner reflector wall surface |
| 76 | a lens cover |
| 78 | a switch |
| 79a | having an "On" position |
| 79b | an "Off" position |
| 80 | a cylindrical shell housing cover |
| 82 | an outer curved wall |
| 84 | an end wall |
| 85 | an interior compartment area |
| 86 | a switch opening |
| 90 | an outer threaded perimeter edge |
| 100 | a storage container |

-continued

GLOSSARY OF THE COMPONENT PARTS

| Part No. | Description of the Component Parts |
|---|---|
| 102 | a lid section |
| 104 | a top wall |
| 106 | side wall |
| 108 | side wall |
| 110 | side wall |
| 112 | side wall |
| 113 | an interior top section area |
| 114 | a storage section |
| 116 | a bottom wall |
| 118 | side wall |
| 120 | side wall |
| 122 | side wall |
| 124 | side wall |
| 125 | an interior bottom section area |
| 126 | a hinge member |
| 128 | a locking member |
| 130a | one or more fluorescent stripes |
| 130b | one or more fluorescent stripes |

DETAILED DESCRIPTION OF THE PREFERRED EMBODIMENT

The hand held lighting device 10 and its component parts of the preferred embodiment of the present invention are represented in detail by FIGS. 1 through 5 of the patent drawings. The handheld lighting device 10 includes a luminescent body/surface/coating 38, such that the luminescent coating 38 provides a light source 38S in which to locate the hand held lighting device 10 in the absence of light.

Figure 1:
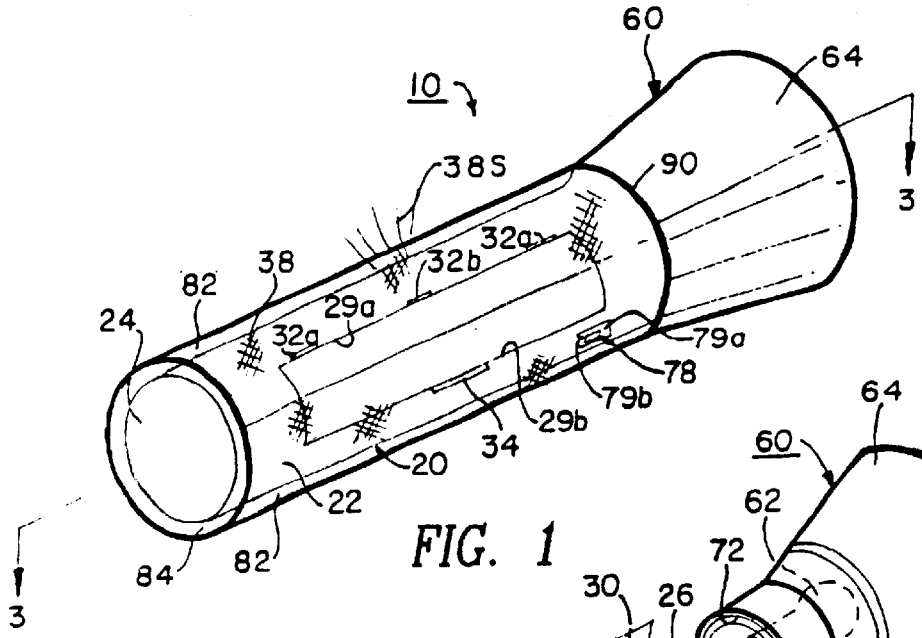
FIG. 1 is a perspective view of the hand held lighting device of the preferred embodiment of the present invention showing the shell housing cover, the device housing having a switch thereon, and the lamp assembly connectedly attached to the device housing, all being in an assembled state.
Figure 2:
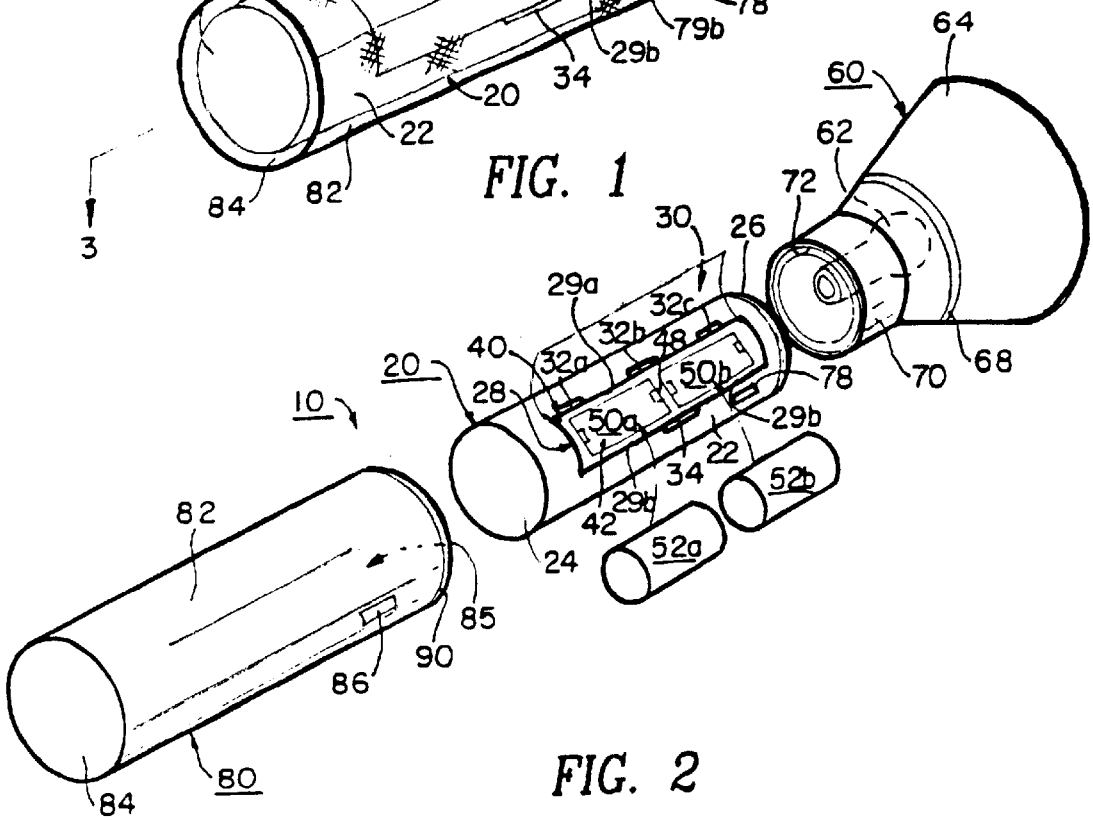
FIG. 2 is an exploded perspective view of the hand held lighting device of the preferred embodiment of the present invention showing the shell housing cover, the device housing having a switch thereon, the batteries and the lamp assembly having a reflector, a lens and a bulb therein.
Figure 3:
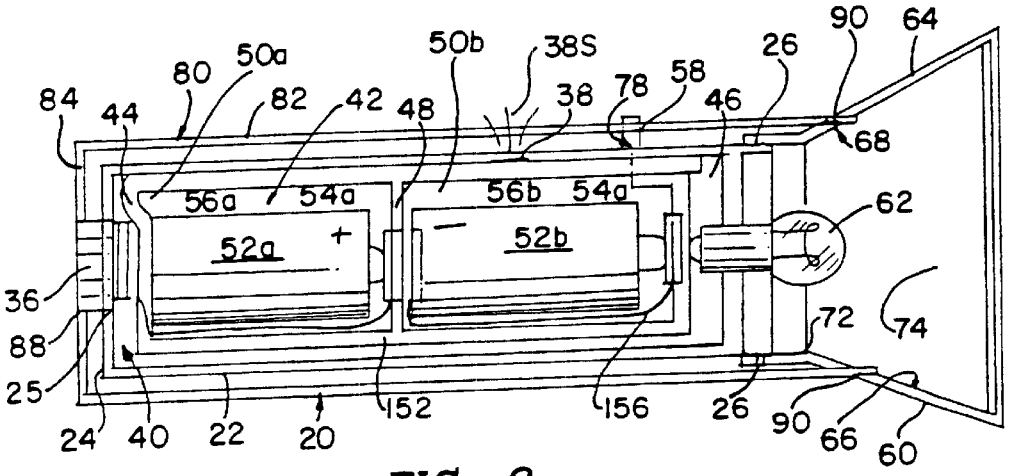
FIG. 3 is a cross-sectional view of the hand held lighting device of the preferred embodiment of the present invention taken along lines 3—3 of FIG. 1 showing the shell housing cover, the device housing having a switch thereon, the batteries and the lamp assembly having a reflector, a lens and a bulb therein.

The hand held lighting device 10 includes a device housing 20 having an interior compartment 40 with a battery storage section 42 contained therein, a lamp assembly 60 detachably connected to the device housing 20, and an outer shell housing cover 80 detachably connected to the lamp assembly 60. Device housing 20, as shown in FIGS. 1 to 3 of the patent drawings, being substantially cylindrical in shape includes an outer curved wall 22, an end wall 24 and an outer threaded perimeter edge 26 for threadedly attaching within the threaded circular receiving channel 72 of neck section 70 of the reflector member 64. In this manner, the device housing 20 is detachably connected to the lamp assembly 60, as depicted in FIGS. 1 and 3 of the patent drawings. The outer curved wall 22 includes a substantially rectangular opening 28 for receiving thereon a battery cover 30 having a plurality of battery cover hinges 32*a*, 32*b* and 32*c* and a battery cover locking member 34 in which to attach the battery cover 30 to the curved wall edges 29*a* and 29*b*, respectively. Additionally, the outer curved wall 22 also includes a small rectangular-shaped switch opening 58 for receiving therein a switch component 78 having an "ON" position 79*a* and an "OFF" position 79*b* in order to provide power to the light bulb 62 of the lamp assembly 60. Device housing 20 can be made from moldable, durable and hard non-breakable plastics, or from formable, light-weight metals like aluminum and stainless steel. Housing 20 has a length measurement in the range of 2 inches to 12 inches; and a diameter measurement in the range of a ½ inch to 3 inches.

Outer curved wall 22, end wall 24 and battery cover 30 have thereon a layer of luminescent coating 38 for providing a light source 38S in which to locate the hand held lighting device 10 in the absence of light. Luminescent coating 38 can also be in the form of stripes (not shown) on the curved wall 22, end wall 24 and/or battery cover of device housing 20 instead of a complete covering of luminescent coating 38 (FIG. 2) on device housing 20 as previously described. The luminescent coating 38 for providing the light source 385 are made from luminescent chemical materials selected from the group consisting of white phosphorous, red phosphorous, phosphors, organic guanines, metallic and non-metallic micas, bismuth oxychloride, phosphorous oxychloride, or other chemiluminescent materials. Light source 38S provided by the aforementioned luminescent chemical materials produces a light source which glows white, red, yellow or green in the absence of light.

The battery storage section 42 is located within the interior compartment 40 of the hand held lighting device 10, as shown in FIG. 3 of the patent drawings. The battery storage section 42 includes a rear end wall 44, a front end wall 46 and a center dividing wall 48 for forming a first battery compartment 50*a* and a second battery compartment sob, respectively, and for holding therein a pair of "D" batteries 52*a* and 52*b*, respectively, within each of the compartments 50*a* and 50*b*, as depicted in FIG. 3 of the drawings. Each of the battery compartments 50*a* and 50*b* include a positive terminal 54*a* and 54*b* and a negative terminal 56*a* and 56*b*, respectively, being electrically connected to form a series circuit.

The lamp assembly 60, as shown in FIGS. 1 to 3 of the drawings, is used for receiving electrical power from batteries 52*a* and 52 in which to light-up the light bulb 62. Lamp assembly 60 includes a light bulb 62, a reflector member 64, a reflector section 66, a first threaded circular receiving channel 68, a neck section 70, and a second threaded circular receiving channel 72. Reflector section 66 includes an inner reflector wall surface 74 for reflecting the light rays from light bulb 62, and a lens cover 76 thereon for filtering the light rays from light bulb 62. Lamp assembly 60 also includes a switch 78 having an "ON" position 79*a* and an "OFF" position 79*b*. Threaded circular receiving channel 68 is used to threadedly receive there in the outer threaded perimeter edge 90 of cylindrical shell housing cover 80, and threaded circular receiving channel 72 is used to threadedly receive therein the outer threaded perimeter edge 26 of device housing 20, as shown in FIG. 2 of the patent drawings.

The shell housing cover 80, as depicted in FIGS. 1 to 4 of the patent drawings, is used for protecting the luminescent coating 38 on the housing 20 of the lighting device 10 in order to protect and prevent the luminescent coating 38 from wearing off or to deteriorate through normal use and handling when changing batteries 52*a* and 52*b* or changing light bulb 62 within lamp assembly 60. Shell housing cover 80 is substantially cylindrically in shape. Shell housing cover 80, as shown in FIG. 2 of the drawings, includes an outer curved wall 82, an end wall 84 for forming an interior compartment area 85 in order to hold and place the housing 20 of the light device 10 therein. Shell housing cover 80 also includes an outer threaded perimeter edge 90 for receiving and engaging with threaded circular receiving channel 68 of lamp assembly 60. Outer curved wall 82 includes a switch opening 86 for receiving therein a switch 78 being mounted on the outer curved wall 22 of housing 20. The shell housing cover 80 can be made from moldable, transparent, durable and hard non-breakable plastics.

Figure 4:
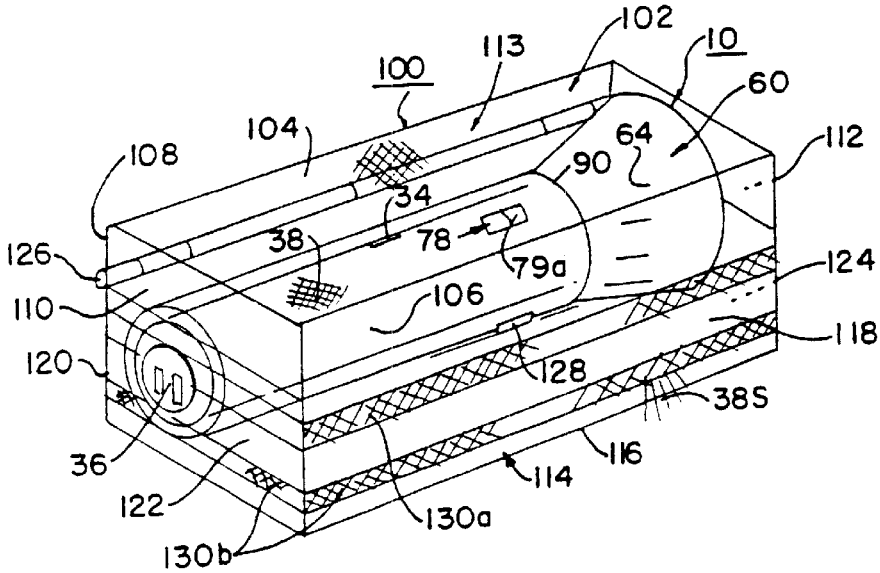
FIG. 4 is a perspective view of the hand held lighting device of the alternate embodiment of the present invention showing the luminescent lighting device within a holding container having a luminescent stripe thereon.

The storage container 100, as depicted in FIG. 4 of the patent drawings, is used for containing and holding the hand held lighting device 10 therein when device 10 is not in use. Storage container 100 includes a lid section 102 and a storage section 114 connected together via hinge member 126. Lid section 102 is held in place and locked to the storage section 114 via locking member 128. Lid section 102 includes a top wall 104, a front wall 106, a rear wall 108 and side walls 110 and 112 for forming an interior top section area 113. Storage section 114 includes a bottom wall 116, a front wall 118, a rear wall 120, and side walls 122 and 124 for forming an interior bottom section area 125 for receiving therein light device 10. Storage section 114 also includes a plurality of fluorescent stripes 130*a* and 130*b* each having a luminescent coating 38 thereon. Fluorescent stripes 130*a* and 130*b* are positioned around the perimeter surface of walls 118 to 124 of the storage section 114, as depicted in FIG. 4 of the patent drawings. The lid section 102 and storage section 114 of storage container 100 can be made from moldable, durable and hard non-breakable plastics.

OPERATION OF THE INVENTION

In operation, the user inserts light bulb 62 within the neck section 70 and reflector section 66 of lamp assembly 60. The user then inserts and screws-in the threaded perimeter edge 26 of housing 20 within the threaded circular receiving channel 72 of lamp assembly for attaching the housing 20 to the lamp assembly 60. Next, the user opens battery cover 30 and inserts two "D" batteries 52*a* and 52*b* within each of the battery compartments 50*a* and 50*b*, respectively, as shown in FIG. 2 of the drawings. The user then closes battery cover 30 via locking member 34, where then the threaded perimeter edge 90 of shell housing cover 80 is inserted and threadedly attached within the threaded circular receiving channel 68 of lamp assembly 60 for connecting the shell housing cover 80 protects the luminescent coating 38 from being damaged by wear and use by the user.

ADVANTAGES OF THE PRESENT INVENTION

Accordingly, an advantage of the present invention is that it provides for a hand held lighting device having a luminescent body for producing a bright light source in order to locate the hand held lighting device in the absence of light.

Another advantage of the present invention is that it provides for a hand held lighting device that includes a luminescent body having a coating made from luminescent chemical materials selected from the group consisting of white phosphorous, red phosphorous, phosphors, organic guanines (fish scales), metallic and nonmetallic micas, bismuth oxychloride, phosphorous oxychloride, or other chemiluminescent materials.

Another advantage of the present invention is that it provides a hand held lighting device that produces a light source from a luminescent material which glows white, red, yellow or green in the absence of light.

Another advantage of the present invention is that it provides for a hand held lighting device that includes a shell housing cover for protecting the luminescent coating on the housing of the lighting device from wearing off or deteriorate through normal use and handling.

A further advantage of the present invention is that it provides for a hand held lighting device having a luminescent coating that is long-lasting, durable in use, and reliable for producing a light source in the absence of light. A still further object of the present invention is to provide a hand held lighting device having a luminescent coating that may be mass produced in an automated and economical manner and is readily affordable by the user.

A latitude of modification, change, and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein.

What is claimed is:

1. A hand held lighting device having a luminescent body for providing a light source in the absence of light, comprising:

a) a housing including an outer curved wall surface, and end wall;

b) said housing including an attached lamp assembly having a light bulb, a reflector member and a lens therein;

c) said housing including a battery cover and an interior compartment having a battery section for receiving one or more batteries for supplying power to said lamp assembly;

d) a switching device in said housing for switching said lamp assembly to battery power in order to energize said lamp assembly;

e) a luminescent coating for producing a light source on said outer curved wall surface, said end wall and said battery cover for affording visibility to said housing of said hand held lighting device in the absence of any other light source;

f) said luminescent coating being formed on, adhered and bonded to said outer curved wall surface, said end wall and said battery cover of said housing, as a distinct and separate layer thereon; and g) a clear and transparent shell housing cover for protecting said luminescent coating from wearing off, said clear and transparent shell housing cover detachably connected to said lamp assembly by connecting means.

2. A hand held lighting device in accordance with claim 1, wherein said luminescent coating is made from a luminescent chemical material selected from the group consisting of white phosphorous, red phosphorous, phosphors, organic guanines, metallic and non-metallic micas, bismuth oxychloride, phosphorous oxychloride and other chemiluminescent materials.

3. A hand held lighting device in accordance with claim 2, wherein said luminescent chemical material for producing said light source includes a glowing color that is white, red, yellow or green.

4. A hand held lighting device in accordance with claim 3, wherein said glowing color of said light source is green.

5. A hand held lighting device in accordance with claim 1, wherein said luminescent coating is made from white phosphorous.

6. A hand held lighting device in accordance with claim 1, wherein said luminescent coating is in the form of stripes on said housing of said hand held lighting device.

7. A hand held lighting device in accordance with claim 1, wherein said housing of said hand held lighting device is made from moldable, rigid plastics or light-weight metals.

8. A hand held lighting device in accordance with claim 1, wherein said housing has a length measurement in the range of 2 inches to 12 inches; and a diameter measurement in the range of a ½ inch to 3 inches.

9. A hand held lighting device in accordance with claim 1, wherein said shell housing cover is made from transparent, durable plastics.

10. A hand held lighting device in accordance with claim 1, wherein said lamp assembly includes a threaded circular receiving channel within said lamp assembly.

11. A handheld lighting device in accordance with claim 1, wherein said connecting means for said clear and transparent shell housing cover includes an outer threaded perimeter edge for detachably connecting to said threaded circular receiving channel within said lamp assembly.

12. A combined hand held lighting device having a luminescent body and container for providing a light source in the absence of light, comprising:

a) a housing including an outer curved wall surface, and end wall;

b) said housing including an attached lamp assembly having a light bulb, a reflector member and a lens therein;

c) said housing including a battery cover and an interior compartment having a battery section for receiving one or more batteries for supplying power to said lamp assembly;

d) a switching device in said housing for switching said lamp assembly to battery power in order to energize said lamp assembly;

e) a luminescent coating on said outer curved wall surface and said end wall for affording visibility to said hand held lighting device in the absence of any other light source; said luminescent coating being formed on, adhered and bonded to said outer curved wall surface, said end wall and said battery cover of said housing, as a distinct and separate layer thereon;

f) a clear and transparent shell housing cover for protecting said luminescent coating from wearing off, said clear and transparent shell housing cover detachably connected to said lamp assembly by connecting means;

g) a container for storing said hand held lighting device therein; and h) said container including outer wall surfaces with one or more luminescent coating strips thereon for affording visibility to said container in the absence of any other light source.

13. A hand held lighting device in accordance with claim 12, wherein said luminescent coating is made from a luminescent chemical material selected from the group consisting of white phosphorous, red phosphorous, phosphors, organic guanines, metallic and non-metallic micas, bismuth oxychloride, phosphorous oxychloride and other chemiluminescent materials.

14. A hand held lighting device in accordance with claim 13, wherein said luminescent chemical material for producing said light source includes a glowing color that is white, red, yellow or green.

15. A hand held lighting device in accordance with claim 14, wherein said glowing color of said light source is green.

16. A hand held lighting device in accordance with claim 12, wherein said luminescent coating is made from white phosphorous.

17. A hand held lighting device in accordance with claim 12, wherein said luminescent coating is in the form of stripes on said housing of said hand held lighting device.

18. A hand held lighting device in accordance with claim 12, wherein said housing of said hand held lighting device is made from moldable, rigid plastics or light-weight metals.

19. A hand held lighting device in accordance with claim 12, wherein said housing has a length measurement in the range of 2 inches to 12 inches; and a diameter measurement in the range of a ½ inch to 3 inches.

20. A hand held lighting device in accordance with claim 12, wherein said shell housing cover is made from transparent, durable plastics.

21. A hand held lighting device in accordance with claim 12, wherein said container is made from transparent plastic.

22. A hand held lighting device in accordance with claim 12, wherein said luminescent coating strips are made with white phosphorous, green phosphorous or red phosphorous.

23. A hand held lighting device in accordance with claim 12, wherein said lamp assembly includes a threaded circular receiving channel within said lamp assembly.

24. A hand held lighting device in accordance with claim 23, wherein said connecting means to said clear and transparent shell housing cover includes an outer threaded perimeter edge for detachably connecting to said threaded circular receiving channel within said lamp assembly.

* * * * *